United States Patent [19]

Rosenblatt

[11] 3,960,779

[45] June 1, 1976

[54] SEMICONDUCTING GLAZE COMPOSITION

[75] Inventor: Gordon Rosenblatt, Toronto, Canada

[73] Assignee: Canadian Porcelain Company Limited, Hamilton, Canada

[22] Filed: Apr. 21, 1975

[21] Appl. No.: 569,991

[52] U.S. Cl. ..... 252/521; 106/46; 106/48; 252/518

[51] Int. Cl.[2] ..... H01B 1/08

[58] Field of Search ..... 252/521, 518; 106/48, 106/46; 427/87, 95

[56] References Cited

UNITED STATES PATENTS

| | | | |
|---|---|---|---|
| 3,484,284 | 12/1969 | Oates et al. | 252/518 |
| 3,502,597 | 3/1970 | Bush | 252/518 |
| 3,795,499 | 3/1974 | Ogawa et al | 427/95 |
| 3,888,796 | 6/1975 | Nigol | 252/521 X |

OTHER PUBLICATIONS

Parmelee C. W. – *Ghazes* – pp. 20–21, pub. by Ind. Pubs., Chicago, Ill. (1951), p. 28.

*Primary Examiner*—Helen M. McCarthy
*Attorney, Agent, or Firm*—Ostrolenk, Faber, Gerb & Soffen

[57] ABSTRACT

A semiconductive glaze composition contains a base glaze in which an alkali metal or alkaline earth metal stannate and antimony pentoxide or trioxide has been incorporated.

13 Claims, No Drawings

SEMICONDUCTING GLAZE COMPOSITION

BACKGROUND OF THE INVENTION

Semiconducting glaze compositions are used to provide a controlled surface resistance on the insulator so that a leakage current flow through the glaze raises the surface temperature of the insulator by a few degrees above ambient at normal operating voltages. This temperature rise of the insulator surface prevents moisture condensation and moisture deposition caused by the hygroscopic nature of some contaminants. This reduces the tendency for electrical discharge.

The semiconducting glaze compositions used for this purpose generally contain a base glaze in which various metal oxides have been incorporated. The composition is normally applied to the surface of the insulator, or to an unfired ceramic body of the insulator, as an aqueous slurry and then fired into the surface.

The surface resistivity of a semiconducting glaze coating applied to a high voltage insulator should be 10-200 MΩ/ square. In order to produce a semiconducting glaze coating having such a surface resistivity, it has been proposed to add various conducting metal oxides to a conventional ceramic glaze composition. One such metal oxide proposed is ferric oxide but its use on an insulator exposed to heavily polluted atmosphere renders the insulator liable to electrolytic corrosion. The glaze also has a tendency to be thermally unstable and the appearance of this glaze is an unfavorable black.

A second metal oxide proposed for use in the semiconducting glaze compositions is titanium oxide. Such glazes, however, are damaged by discharges resulting in the loss of conductivity due to re-oxidation of the titania. Additionally, the conditions of preparation, particularly the firing conditions, must be strictly controlled and the process of glazing with this semiconducting glaze composition is complicated. As a result, this glaze composition is not ordinarily employed.

Most semiconducting glaze compositions use a combination of stannic oxide with a small amount of antimony pentoxide or antimony trioxide in a conventional porcelain glaze base. The slurry so obtained is applied to "green" procelain insulator shells by dipping, spraying or flooding and the insulator shells are fired in a pre-set cycle which matures the glaze and porcelain providing, as an end result, a glaze with a controlled surface resistivity and a porcelain body with the required electrical and mechanical strength.

Aside from the resistivity of these glazes, an important additional electrical characteristic which must be provided for is a low temperature coefficient of resistivity, so that the glaze resistivity does not significantly change with increased or decreased ambient temperatures. This temperature coefficient is commonly expressed as the half temperature (T ) which is defined to be the temperature interval in degrees Centigrade in which the resistivity of the glaze drops to one-half of its initial value. Thus, a high T denotes a low temperature coefficient of resistivity.

It has been found that in order to provide a low temperature coefficient of resistivity, i.e., a high T , stannic oxide-antimony pentoxide (or trioxide) glazes, the loading of the semiconducting phase (stannic oxideantimony oxide) must be low, the particle size distribution of the stannic oxide must be narrow and submicron in range, and the firing cycle must be very carefully controlled. Control in the firing cycle includes both the time and temperature of the peak soaking period as well as the final cooling rate of the glaze. Some increase in T may be achieved by changing the composition of the base glaze if the firing cycle is optimal and also very carefully controlled. When all of the processing variables are optimized, glazes with a T of up to 200° C. can be obtained. However, these glazes are extremely sensitive to firing variables.

I have now found a new semiconductive glaze composition which is particularly useful on high voltage ceramic insulators, which is much less sensitive to firing variables and has a greatly improved low temperature coefficient of resistivity. Indeed, glazes with T which are double and triple those obtained using stannic oxide can be obtained routinely. Advantageously, the same procedures as employed to prepare known glaze compositions can be used to prepare the glaze compositions of this invention.

Accordingly, it is the object of this invention to provide a novel semiconducting glaze composition suitable for use on high voltage ceramic insulators which have a high half temperature. This and other objects of the invention will become apparent to those skilled in this art from the following detailed description.

SUMMARY OF THE INVENTION

This invention relates to semiconducting glaze compositions for use as electrical conductive glaze coatings on ceramic insulators. More particularly, the invention relates to semiconducting glaze compositions in which the semiconducting phase is a mixture of an alkali metal or alkaline earth metal stannate and antimony pentoxide or antimony trioxide.

DESCRIPTION OF THE PREFERRED EMBODIMENTS

In accordance with the present invention, a semiconducting-glaze composition is provided of a semiconducting phase containing a stannate and an antimony oxide, and a base glaze.

The base glaze, or cover glaze, employed is conventional and will therefore not be described in any great detail here. The particular composition will, in general, have some effect on the final semiconductive glaze and those skilled in the art can readily select the appropriate base glaze for the particular insulator. Two typical base glaze compositions are as follows:

Base Glaze Composition A

| Component | % By Weight |
|---|---|
| $SiO_2$ | 70.00 |
| $Al_2O_3$ | 13.66 |
| CaO | 11.84 |
| $K_2O$ | 2.71 |
| $Na_2O$ | 0.76 |
| $TiO_2$ | 0.34 |
| $Fe_2O_3$ | 0.30 |
| MgO | 0.09 |

Base Glaze Composition B

| | |
|---|---|
| $SiO_2$ | 70.75 |
| $Al_2O_3$ | 11.64 |
| CaO | 13.91 |
| $K_2O$ | 2.50 |
| $Na_2O$ | 0.68 |
| $TiO_2$ | 0.18 |
| $Fe_2O_3$ | 0.28 |
| MgO | 0.06 |

In each of these base glazes, the mean particle size is less than 10 microns.

The semiconducting phase of the semiconducting glaze composition contains a stannate and an antimony oxide. As the antimony oxide component, either antimony pentoxide or antimony trioxide can be used. Of the two antimony oxides, the antimony pentoxide is preferred.

The stannates have the general formula $M_xSnO_3$ where M is an alkali metal or an alkaline earth metal and $x$ is 1 or 2. M can thus be either sodium, potassium, rubidium, cesium, magnesium, calcium, strontium or barium. If desired, mixtures of the stannates can also be employed. Of the various stannates, the calcium stannate is, at present, preferred.

The stannate is the major component of the semiconducting phase. In general, the stannate will be about 60–95 weight percent of the phase and preferably about 75–85 weight percent of the phase, the percentages being based on the total weight of the dry solids. The mean particle size of the solids in the semiconducting phase is preferably less than about 1 micron and most preferably less than about 0.5 micron, in order to improve the general uniformity of the resultant glaze.

The semiconducting phase will generally be about 3.5–20 weight percent based on the total weight of the dry solids in the semiconducting phase and the base glaze, and preferably about 8–13 weight percent. Accordingly, the stannate is about 3.5–19 weight percent, preferably 6–12 weight percent based on the weight of the total solids in the semiconducting glaze composition and the antimony oxide is about 0.2–6 weight percent, preferably 0.5–2 weight percent.

The stannate and antimony oxide can be mixed together in proper proportions with the base glaze materials and water to produce a glazing slurry or slip. The slurry is applied to unfired but dry porcelain insulators, or to pre-fired porcelain insulators, by dipping, spraying or flooding. The insulators are then fired so as to produce the required semiconductive properties of the glaze and high mechanical strength of the insulator bodies and the glaze. The use of this procedure with prior art glazes was limited since the insulator had to be fired within a temperature range that would produce the required semiconductive properties of the glaze and mechanical properties of the porcelain insulator, and these properties were quite temperature dependent. The temperature dependency of semiconductive glaze compositions containing the stannates of this invention, however, is much less than that with glaze compositions containing, e.g., stannic oxide.

The semiconducting glaze composition can also be prepared by mixing the stannate and antimony oxide and calcining the mixture at a temperature of about 1000°–1300° C. In the calcination process, the antimony component is doped into the stannate component to develop electrical conductivity. The calcined mixture is then ground and mixed in proper proportions with the base glaze materials and water to produce the glazing slurry or slip, which in turn is applied to the insulator.

Whichever procedure is employed, the glazing slurry or slip generally contains water in an amount corresponding to a water-to-solids ratio of about 50:50 to 50:40, and preferably about 52:48 to 56:44.

Conventional semiconductive glazes containing, e.g., stannic oxide, are very sensitive to the maximum firing temperature and, to a smaller degree, to the time duration of this maximum temperature (termed "soaking time"), and also to the rates of heating and cooling during the firing cycle. The total resistance of an insulator must be reasonably well controlled and since kiln temperatures are never uniform in practice, a large variation could occur in the glaze resistivity. The semiconducting glaze compositions of the instant invention, however, are not as sensitive to the maximum firing temperature and soaking time and therefore rejection rates are much lower than with the conventional semiconducting glaze compositions. It is still good practice, however, to regulate the firing temperature and soaking time as much as possible. In general, the maximum firing temperature should be within the range of 2200°–2400° F. and preferably about 2300° F. The soaking time is usually about 2–10 hours, and preferably about 6 hours.

For the purpose of comparing the semiconducting glaze composition of this invention with conventional semiconducting glaze compositions, two glazes were prepared. In each of these compositions, base glaze composition B, described above, was used in an amount of 91% by weight of the total dry solids and antimony pentoxide was used in an amount of 1 weight percent of the total dry solids. In one composition 8 weight percent calcium stannate was used and in the other, 8 weight percent stannic oxide was employed. Both glaze compositions were converted into 55% aqueous slurries which were then applied to "green" porcelain insulator shells and fired at 2300° F. for 6 hours. The stannic oxide containing glaze coated shell exhibited a surface resistivity of about 56–62 MΩ/square and a glaze T of about 100. The calcium stannate containing glaze coated shell exhibited a surface resistivity of 64–66 MΩ/square and a glaze T of 250.

Surface resistivity can be altered, as desired, by varying the loading of the stannate, changing the peak soaking temperature and the length of the soaking period, as well as changing the amount of the antimony oxide. It can also be varied by the particular stannate employed. For example, strontium stannate in base glaze composition B at an 8% level (1% antimony oxide) produces satisfactory glazes (up to 200 MΩ/square) while magnesium stannate requires slightly more, about 10% (1% antimony oxide), at the same firing cycle.

Various changes and modifications can be made in the process and products of this invention without departing from the spirit and the scope thereof. For example, changes in the glaze resistivity can be effected by varying the water-to-solids ratio, the particle sizes of the various glaze components, or the firing temperature and firing cycle. Additionally, the resistivity of an applied semiconductive glaze can be increased or decreased by refiring the insulator to which the glaze is applied at a different temperature from that at which it was first fired. Additionally, zinc oxide in an amount of 0.5–3 percent by weight can be in the glaze for stabilizing the resistivity during firing. Accordingly, the various embodiments disclosed herein were for the purpose of further illustrating the invention but were not intended to limit it.

The embodiments of the invention in which an exclusive privilege or property is claimed are defined as follows:

1. In a semiconducting glaze composition for use on electrical insulators containing a base glaze and a semiconducting phase, the improvement which comprises employing as the semiconducting phase, a mixture of an alkali metal or alkaline earth metal stannate and an antimony oxide, the stannate being about 60–95% by weight of the semiconducting phase and the remainder of said phase being antimony oxide, said semi-conducting phase being about 3.5–20% of the total weight of dry solids in the semi-conducting phase and the base glaze, the glaze when fired exhibiting a surface resistivity of about 10–200 MΩ/square and a low temperature coefficient of resistivity.

2. The semiconducting glaze composition of claim 1 wherein the antimony oxide is antimony pentoxide or antimony trioxide.

3. The semiconducting glaze composition of claim 1 wherein the weight percent of stannate in the semiconducting phase is about 75–85.

4. The semiconducting glaze composition of claim 1 wherein said stannate is about 3.5–19 weight percent based on the total weight of the dry solids in said composition.

5. The semiconducting glaze composition of claim 4 wherein the amount of said stannate is about 6–12 weight percent.

6. The semiconducting glaze composition of claim 1 wherein said antimony oxide is about 0.2–6 weight percent based on the total weight of the dry solids in said composition.

7. The semiconducting glaze composition of claim 6 wherein said antimony oxide is about 0.5–2 weight percent based on the total weight of the dry solids in said composition.

8. The semiconducting glaze composition of claim 1 wherein said stannate is calcium stannate.

9. The semiconducting glaze composition of claim 1 wherein said stannate is strontium stannate.

10. The semiconducting glaze composition of claim 1 wherein said stannate is magnesium stannate.

11. A glazing slip comprising an aqueous slurry of the semiconducting glaze composition of claim 1.

12. An electrical insulator having the semiconducting glaze composition of claim 1 as a coating thereon.

13. The electrical insulator of claim 12 wherein said insulator is a porcelain insulator.

* * * * *